US005827133A

United States Patent [19]

Chang

[11] Patent Number: 5,827,133

[45] Date of Patent: Oct. 27, 1998

[54] REDUCED SPIN GOLF BALL

[76] Inventor: Dale U. Chang, 2900 Sun Bittern Ct., Windermere, Fla. 34786

[21] Appl. No.: 845,444

[22] Filed: Apr. 25, 1997

[51] Int. Cl.[6] ..... A63B 37/12; A63B 37/14

[52] U.S. Cl. ..... 473/370; 473/374; 473/377; 473/378

[58] Field of Search ..... 473/354, 364, 473/370, 373, 374, 376, 377, 378, 371, 367

[56] References Cited

U.S. PATENT DOCUMENTS

| | | | |
|---|---|---|---|
| 790,252 | 5/1905 | Mahaut | 473/370 X |
| 2,542,356 | 2/1951 | Radford | 473/376 |
| 3,517,933 | 6/1970 | Malkin | 446/267 X |
| 5,026,054 | 6/1991 | Osher et al. | 446/267 X |
| 5,150,906 | 9/1992 | Molitor et al. | 473/354 |

*Primary Examiner*—George J. Marlo

*Attorney, Agent, or Firm*—James H. Beusse; Maguire, Voorhis & Wells

[57] ABSTRACT

A golf ball having a reduced spin rate is provided for minimizing the tendency of the golf ball to hook or slice in response to a sliding blow from a golf club. The golf ball may have a cover that is constructed to have a slippery surface such that when the club strikes the ball the club slides on the surface rather than imparting spin to the ball. In addition, the cover may be isolated from the inner core of the golf ball by an intervening lubricating layer which allows the cover to slip on the core so that any spin imparted to the cover is only minimally transferred to the core thereby minimizing spin of the golf ball. The golf ball may also be constructed with a fluid core either of a liquid or gelatinous substance which will not respond to any initial spin imparted to the outer cover of the golf ball and will thereby retard the spin rate of the ball.

10 Claims, 1 Drawing Sheet

REDUCED SPIN GOLF BALL

The present invention relates to golf balls and, more particularly, to a golf ball having a low spin rate.

BACKGROUND OF THE INVENTION

The majority of commercially available golf balls are advertised as having high spin rates since such spin rates are desirable for the better golfer. A high spin rate in a golf ball indicates that the ball rotates very rapidly about its axis when struck by the skilled player. The advantage of the high spin rate is that the ball can be made to produce a reverse or back spin so that the ball stops very quickly when hit into a green on an approach shot.

While high spin rates are desirable for the professional or better golfer, most amateur golfers are not capable of hitting a ball in a manner to produce controlled spin on the ball. More importantly, most amateur golfers have a swing which is either an inside- out or outside-in swing that produces side spin on the ball. Side spin causes the ball to move laterally off a desired target line, i.e., in either a hook or slice direction. For such amateur golfers, a better golf ball would be a ball with a reduced or even zero spin rate so that the ball travels in essentially a straight line from the club face without the detrimental side spin. A ball which eliminates most of the spin will travel a further distance in a desired direction.

U.S. Pat. No. 5,368,304 describes a low spin golf ball in which the spin rate is reduced by using the combination of a soft core and a hard outer cover. In addition, that patent suggests that spin rate can be further reduced by decreasing the weight of a softened polybutadiene core while maintaining core size and by increasing the thickness of the cover. The golf ball in the '304 patent may also be made larger than the standard 1.680 inch golf ball to provide a further reduced spin rate. While these designs are successful in reducing the spin rate of golf balls, many golfers object to a golf ball which has a very hard feel such as occurs when using a very hard cover on a golf ball. When struck with an iron club, such golf balls tend to induce vibrations into the club which are undesirable even to the unskilled golfer. Furthermore, while the use of a ball which is slightly oversized, such as, for example, the Top Flite Magna™ sold by Spalding & Evenflo Companies, Inc., many golfers are opposed to using an oversized ball and would prefer to have a ball which is the same size as those played by professional golfers. Accordingly, it would be desirable to provide a ball which has the same general feel and size characteristics of the ball used by professional golfers while at the same time having the advantage of a very low or zero spin rate to compensate for side spin often induced by the amateur golfer.

SUMMARY OF THE INVENTION

A golf ball in accordance with the present invention for reducing spin rate is manufactured with a thin layer of a lubricant between the outer cover of the ball and the inner core. The lubricant may be in the form of an oil, grease or dry lubricant, or a mixture of these lubricants. The golf ball may be constructed with an inner solid core formed of a polybutadiene elastomeric material and an outer cover formed of a thermal plastic resin such as ionomer resin to create a conventional two-piece golf ball. For the two-piece ball, the core may be dipped in the lubricant prior to compression molding the outer cover onto the core. The thickness of the lubricant coating may be in the range from 0.01 to 5.0 mils (thousandths of an inch) to essentially isolate the cover from the core through the lubricant. The oil or grease in which the core is dipped to form the lubricant coating may be mixed with molybdenum disulfide (MoS2), graphite or polytetrafluoroethylene (PTFE) particles to further improve lubrication. When a ball constructed in accordance with this arrangement is struck by a club, the outer skin tends to slip or slide with respect to the inner core so that the spin normally imparted to the ball by striking with a club is substantially reduced, i.e., the cover can spin but such spin is not fully transferred to the core. Further, the core has substantially more mass than the outer cover and even if given some spin will have less of a spin than the outer cover and therefore will tend to slow the cover speed rapidly to the same speed as the core through the reduced frictional interface between the cover and core. More particularly, even though there is a lubricant interface between the core and cover, the cover is still tightly bound about the core and the coefficient of friction, while significantly reduced, still exists with respect to the cover and core through the lubricant interface.

The use of a lubricant between the outer cover and inner core may be extended to golf balls in which there is an inner cover interposed between the core and the outer cover such as, for example, in the Top Flite™ golf balls sold under the tradename Strata™. This double cover arrangement in a golf ball provides for a further opportunity to isolate the outer cover from the inner core using a lubricant interface. In particular, the inner core can be covered by a lubricant prior to compression molding the inner cover over the core and then a second layer of lubricant can be placed over the inner cover prior to molding the outer cover over the ball. In this respect, there is now two lubricant layers which provides for greater opportunity for the outer cover to rotate with respect to the inner core in response to being struck by a golf club. However, any spin imparted to the outer cover will be quickly absorbed by the inner cover and inner core to either stop or reduce the overall spin rate of the golf ball and minimize any tendency of the ball to have a spin rate which would cause the ball to fly off line. It will be recognized that the invention may also be applied to conventional three-piece balls, i.e., balls which have an inner wound core and an outer cover of either a natural or synthetic polymeric composition.

A still further improvement in reducing spin rate of a golf ball can be achieved by incorporating a lubricating material into the polymeric composition forming the outer cover of a golf ball. For example, the outer surface layer of the outer cover may be molded with polytetrafluoroethylene (PTFE) fibers, molybdenum disulfide powders, silicon fluids or graphite particles imbedded in the outer surface. If the outer surface of the outer cover is formed with one of these lubricating materials incorporated, the outer surface will have a slippery reaction when struck by a club which would cause the club to slide on the cover rather than gripping the cover and thereby minimize the spin rate of the golf ball. Still another improvement in reducing the spin rate of a golf ball may be obtained by replacing the solid inner core with a fluid core. In this embodiment, the outer cover of the golf ball may have to have an increased thickness in order to tolerate the high pressure necessary to give the golf ball the feel of the conventional golf ball having anywhere from 80 to 105 compression. Furthermore, since the entire core of the golf ball is being replaced by a fluid center, the specific weight of the fluid must match the specific weight of the elastomer core in order to satisfy USGA requirements for a golf ball. The specific weight of the fluid core may be varied by mixing a powder formed of heavy materials such as lead into the fluid so that the powder remains in a suspension in the fluid or is emulsified with heavy materials. The fluid may be in the form of a heavy gel rather than a liquid material. As will be appreciated, even though the outer cover is struck with sufficient force to cause the cover to spin, the spin will not be easily transferred to the inner fluid core during the relatively short time period in which the golf club is in contact with the golf ball whereas the core material will rapidly stop the spin of the outer cover after the golf ball has been struck.

BRIEF DESCRIPTION OF THE DRAWINGS

For a better understanding of the present invention, reference may be had to the following detailed description taken in conjunction with the accompanying drawings in which.

DETAILED DESCRIPTION OF THE INVENTION

Figure 1:
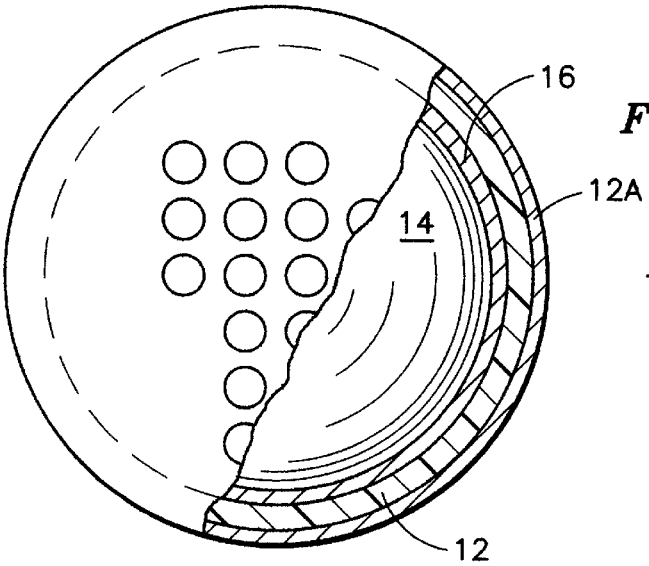
FIG. 1 is a partial cross-sectional view of a golf ball showing one application of the present invention.

The present invention relates to a golf ball and method of manufacturing a golf ball which complies with the United States Golf Association (USGA) regulations and minimizes the tendency of a golf ball to hook or slice when struck by a golf club. FIG. 1 illustrates in partial cross-sectional view the structure of a conventional two-piece golf ball incorporating at least some of the teaching of the present invention. In particular, the golf ball illustrated in FIG. 1 includes an outer elastomeric cover 12 typically formed of an ionomer resin such as that sold by E. I. Dupont de Nemours Company under the trademark "Surlyn". The cover 12 overlays an inner core which is typically molded from an elastomeric composition such as polybutadiene with various additives. A more comprehensive discussion of various compositions which may be used to form the core 14 and the outer cover 12 is given in U.S. Pat. No. 5,368,304. The particular compositions of which the core 14 and cover 12 are produced is not considered a part of the invention in this first embodiment. In the first embodiment of the present invention, the outer cover 12 is separated from the inner core 14 by a relatively thin layer of a lubricating material 16. The lubricating layer 16 forms a boundary layer between the cover and core having a thickness in the range of 0.01 to 5.0 mils and preferably between 0.5 to 1.0 mils. The boundary layer 16 allows the opposing surfaces of the cover and core to partially ride on a lubricating film and to partially rub together as surface high points come in contact. The lubricating film provides a low coefficient of friction between the mating surfaces of the core and outer cover to reduce transmission of any friction force to the core from the cover.

When the golf ball of FIG. 1 is struck by a golf club in such a manner as to attempt to induce rotation or spin of the ball about an axis passing through the center of the ball, the outer cover 12 will momentarily slip about the core 14 due to the low coefficient of friction induced by the lubricating layer 16. The actual time during which the club face is in contact with the ball can be measured in milliseconds so that the time during which the cover is experiencing an accelerating force is relatively short. As soon as the club face loses contact with the ball, the inertia of the core 14 causes any spin induced in the cover to rapidly drop to the spin velocity of the core. Core spin velocity may be approximately zero.

Figure 2:
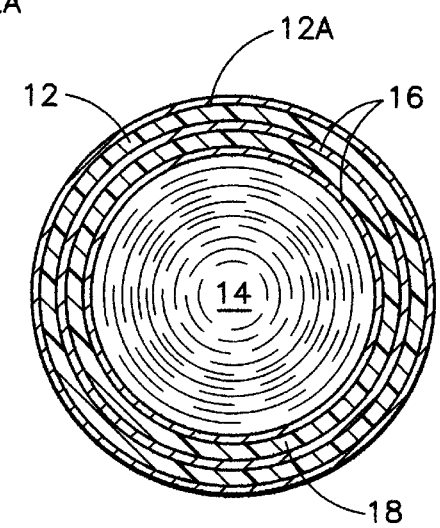
FIG. 2 is a schematic representation of a golf ball with which the present invention may be used.

FIG. 2 is a schematic representation of a two-piece golf ball having a double outer cover, such as that found in the Top Flite Strata™ golf ball. In this embodiment, the inner core 14 is first enclosed in an inner cover 18 and then the outer cover 12 is compression molded over the inner cover. In order to create a slipping or sliding interface between the outer cover 12 and inner core 14, it may be desirable to incorporate a first lubricating interface between the core and inner cover 18 and a second lubricating interface between the inner cover 18 and outer cover 12. As with the golf ball of FIG. 1, the inner core is typically formed of a elastomeric composition which is compression molded into the approximate shape of the golf ball. The resultant inner core 14 may then be either dipped or sprayed with a lubricating film prior to inserting into a compression mold in which the inner cover 18 is compression molded to the core. The outer surface of the inner core then is covered with a lubricating film by, for example, dipping the ball into a liquid or fluid bed or spraying the inner cover with a lubricating film or by other means known in the art. The film covered ball is then placed into a final compression molding operation in which the outer cover 12 is compressly molded to the ball. The conventional dimples are normally formed in the outer cover during this final compression molding step.

While ease of manufacturing may dictate that the lubricating film be placed on the ball during the manufacturing process by dipping the ball into a lubricating material, it may be desirable in some applications to form the ball with a relatively thin layer of a lubricating material such as PTFE (Teflon®). Use of a solid material for the lubricating film may be desirable in the case where the inner core 14 is a wound core such as commonly found in golf balls manufactured by the Acushnet company under the trademarks Titleist Tour or Titleist DT. It may even be practical to coat the PTFE layer with another layer of a lubricating material such as a petroleum lubricant or a synthetic lubricant.

The following materials are exemplary of the types of materials that may be used to form a lubricating film between the outer cover 12 and inner core 14 or inner cover 18:

1. Petroleum based lubricants such as oil and grease.
2. Synthetic lubricants in the form of oil and grease such as polyglycols, phosphate esters, chlorofluorolubricants, polyphenyl esters, silicones, dibasic acid esters (or diesters), esters, polyethers, polyaromatics, silicate esters, and highly fluorinated compounds.
3. Solid lubricants including MoS2 (molybdenum disulfide), PTFE (polytetrafluoroethylene), and graphite.

In still another embodiment of the present invention, the solid inner core 14 is replaced by a fluidized material such as a liquid or a semi-solid gel material. "Fluid" as used herein includes liquids and high viscosity materials such as grease or other gels, or visco-elastic materials such as SORBOTHANE™ (Sorbothane, Inc.) and Viscolas™ (Isoloss, Inc.). For example, the core could be formed from a petroleum based or synthetic lubricant such as mineral oil, polyglycol or glycerin. It is believed that any type of liquid material which has approximately the same specific gravity as the conventional elastomeric material used for forming a core could be used in this application or that weight of the core material could be adjusted by suspending a metal powder, such as lead, or other material to create a suitable liquid emulsion. The liquid should be uniform in density and homogeneous so that it does not stratify or segregate when not in motion. Various techniques are known in the art for forcing a liquid into a core under appropriate pressures. Typically, the pressure with which the liquid is inserted through the outer cover of the ball is such as to create a ball having a desired compression characteristic. For example, a typical golf ball may be rated for 90 or 100 compression and forcing the liquid into the outer cover with such pressure is readily accomplished. In creating the golf ball using a liquid core, it will be appreciated that the outer cover may have an increased thickness in order to withstand the pressure of the liquid core. The thickness of the core would be determined by the type of material used for creating the outer cover. With a standard ionomer such as the ionomer sold under the trademark Surlyn, it is believed that the cover could be within a standard range of thickness of about 0.0675 inches for a solid core and can be thicker in case of liquid core.

In a still further embodiment of the present invention, the outer cover 12 of a golf ball may be impregnated with a lubricant such as PTFE or molybdenum disulfide or graphite mixed with silicone fluid. Silicone fluid can also be mixed with PTFE fibers for further lubricity. Such material may be impregnated in at least an outer surface layer 12A (See FIG. 1) of the outer cover by placing the lubricating material in the compression mold at the time that the outer cover is compressed onto the inner core or the outer cover material could be pre-impregnated before compression molding. The material of the outer cover is typically warmed by the compression molding process allowing the lubricating material to diffuse into the outer surface of the cover. The preferred lubricating material is a dry material such as the PTFE, MoS2 and graphite materials listed above which will give the outer surface a slippery characteristic so that when struck by a golf ball, the cover will tend to slide on the club face rather than to stick to the club face and thereby reduce the spin imparted to the ball by the club face. Addition of a silicone fluid will improve the slippery characteristic. In a preferred embodiment, the concentration of PTFE in the outer cover is between 15–20% by weight with 1–5% silicone fluid. The only reason for not selecting MoS2 and graphite for the outer cover is the darkening of the cover from these compounds. The cover material may be maintained in its normal white configuration by the addition of coloring agents to the cover material prior to the compression molding step. Such materials are well known in the art and may include such coloring agents as titanium dioxide. The amount of coloring agent may be adjusted to compensate for any discoloration caused by the infusion of the lubricating material into the outer surface layer of the outer cover.

Figure 3:
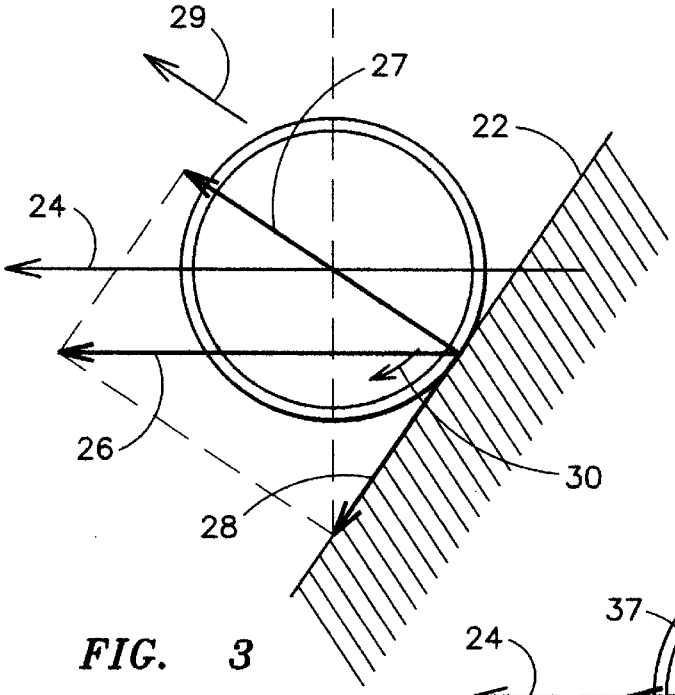
FIG. 3 illustrates the effect of an angled club face striking a golf ball.
Figure 4:
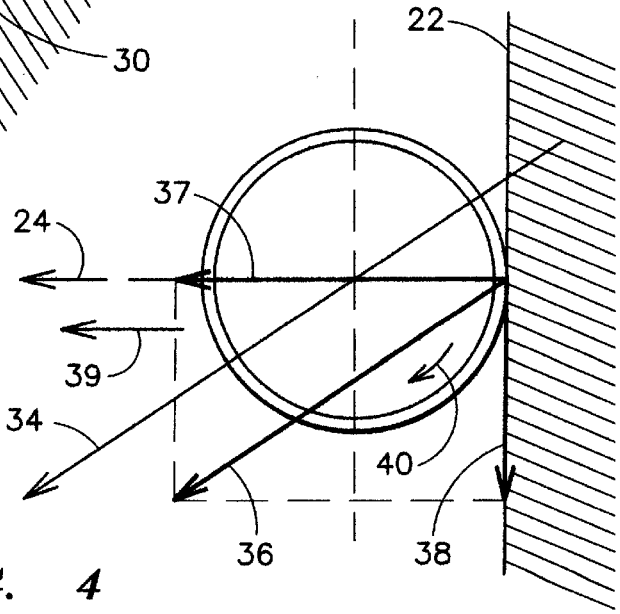
FIG. 4 illustrates the effect of a club face striking a ball when the face is square to a target line and the path of club travel is off line.

In order to understand the mechanism by which the present invention overcomes the tendency of a golf ball to spin and thus impart side ways motion to the golf ball, reference is now made to FIGS. 3 and 4 which illustrate the various forces imposed on a golf ball by a club face striking a ball with either the club face in an open position with respect to desired line of flight of the ball or with the club face square to the desired target line but with the direction of impact being at an angle to the desired target line. Turning first to FIG. 3, the club face 22 is shown in an open position with respect to the desired target line 24. As a result, the club face initially contacts the ball at a point inside (with respect to the golfer's position) the target line 24 which extends through the center of the ball causing the hitting force 26 to divide into normal force component 27 and tangential force component 28. The normal force 27 is used to carry the ball in the ball flight direction 29 while the tangential force 28 generates a moment about the center of the ball causing the ball to rotate as indicated by the arrow 30. The tangential force 28 is reduced if the coefficient of friction between the club face 22 and the ball is low. This low tangential force will generate low moment thus causing less spin to the ball for less slice. The spin imparted to the golf ball, in this example, a counterclockwise spin, causes the ball to have a slicing path of travel, i.e., to move in a clockwise direction.

A similar result occurs if the club face is actually square to the target line 24 but approaches the target line at an angle such as that indicated at 34 of FIG. 4. In this example, the club face initially contacts the ball at a point on the target line 24 extending through the center of the ball but the direction of travel of the club creates a hitting force 36 which divides into normal force component 37 and tangential force component 38. The normal force 37 is used to carry the ball in the ball flight direction 39 while the tangential force 38 generates a moment about the center of the ball causing the ball to rotate as indicated by the arrow 40. As a result, the ball leaves the club face in the general direction 39 of the target line but then deviates into a slice or clockwise motion away from the target line.

In both the actions illustrated in FIG. 3 and in FIG. 4, if the frictional force (tangential forces 28 and 38) between the club face and the ball can be reduced so that the ball is not imparted with a spinning motion by its impact with a club, then the ball will have more of a tendency to travel in a straight line as it leaves a club. Such reduction in frictional force can be achieved by making the outer cover "slippery" as described above. Although the ball flight in FIG. 3 is not likely to be in the desired direction, i.e., along the target line, it will at least fly in a straight direction rather than veering substantially off of the initial ball flight path due to the spin on the ball. In the situation illustrated in FIG. 4, the ball will actually move along the target line even though the path of the club face is not along the target line. By eliminating the spin imparted to the ball by the club face, the path can be straight even though the club face is not moving in that target line direction. Applicant's invention in one form allows the outer cover to grip the club face and receive spin but isolates the center core from such spin so that shortly after the ball loses contact with the club face, the spin of the ball is substantially reduced due to the frictional force between the cover and the surrounding air, the frictional force between the cover and the ball core and the inertia of the core. In another form, the outer cover is designed to slip against the club face and minimize the transfer of the frictional (tangential) force which creates spin on the ball.

The liquid core helps to dissipate any residual spinning energy imparted to a golf ball by viscous friction within the liquid. Even with intentional lubricity of the surface of the cover, the lubricity between outer and inner covers, and the lubricity between inner cover and core, some spinning will be transmitted to the core. The liquid core will further inhibit the spinning of the ball by dissipating the rotational energy through internal friction of the liquid.

The techniques described in this invention can be used singularly, collectively or in any combination. The desired degree of spin reduction and the ease of manufacturing may determine the particular technique selected for implementation.

While the invention has been described in what is presently considered to be a preferred embodiment, many variations and modifications will become apparent to those skilled in the art. Accordingly, it is intended that the invention not be limited to the specific illustrative embodiment but be interpreted within the full spirit and scope of the appended claims.

What is claimed is:

1. A golf ball comprising:

an inner core;

an outer cover tightly encompassing said core and having a plurality of uniformly distributed dimples on an outer surface thereof; and a lubricant film between said core and cover to allow said cover to slip with respect to said core.

2. The golf ball of claim 1 and including an inner cover between said core and said outer cover and a lubricating film between said inner cover and said outer cover.

3. The golf ball of claim 1 and including lubricant diffused into at least an outer surface layer of said outer cover.

4. The golf ball of claim 3 and including an inner cover between said outer cover and said core.

5. The golf ball of claim 1 wherein said lubricant film is selected from the group comprising:

petroleum based lubricants such as oil and grease; synthetic lubricants including oil and grease of polyglycols, phosphate esters, chlorofluorolubricants, polyphenyl esters, silicones, dibasic acid esters (or diesters), esters, polyethers, polyaromatics, silicate esters, and highly fluorinated compounds; solid lubricants including MoS2 (molybdenum disulfide), PTFE (polytetrafluoroethylene), graphite and silicone fluid.

6. A golf ball suitable for playing the game of golf comprising an inner core and a uniformly dimpled outer cover, said outer cover having a lubricant diffused into at least an outer surface layer of said cover.

7. The golf ball of claim 6 and including an inner cover between said core and said outer cover.

8. The golf ball of claim 6 wherein said lubricant is a dry lubricant selected from the group comprising MoS2, PTFE and graphite.

9. The golf ball of claim 8 and including silicone fluid diffused into said outer cover.

10. The golf ball of claim 8 wherein said lubricant comprises between about 15–20% by weight of PTFE, 1–5% by weight silicone fluid and wherein the total percentage of PTFE and silicone fluid does not exceed 20% by weight of said outer surface layer of said cover.

* * * * *